United States Patent [19]

Melcher et al.

[11] Patent Number: 4,666,132

[45] Date of Patent: May 19, 1987

[54] METHOD AND APPARATUS FOR THE PYROMETALLURGICAL TREATMENT OF FINE GRAINED SOLIDS TO PRODUCE MOLTEN PRODUCTS

[75] Inventors: Gerhard Melcher; Friedrich Megerle, both of Köln; Wolfgang Wuth, Berlin, all of Fed. Rep. of Germany

[73] Assignee: Klöckner-Humboldt-Deutz Aktiengesellschaft, Fed. Rep. of Germany

[21] Appl. No.: 790,946

[22] Filed: Oct. 24, 1985

Related U.S. Application Data

[62] Division of Ser. No. 657,122, Oct. 3, 1984, Pat. No. 4,566,903.

[30] Foreign Application Priority Data

Oct. 3, 1983 [DE] Fed. Rep. of Germany ..... 3335859

[51] Int. Cl.[4] ..... F27D 3/18

[52] U.S. Cl. ..... 266/182; 266/221; 266/267

[58] Field of Search ..... 266/182, 221, 267

[56] References Cited

U.S. PATENT DOCUMENTS 3,607,224 9/1971 Blaskowski ..... 75/26

3,759,501 9/1973 Foard ..... 266/182

*Primary Examiner*—Melvin J. Andrews

*Attorney, Agent, or Firm*—Hill, Van Santen, Steadman & Simpson

[57] ABSTRACT

A method and apparatus for the pyrometallurgical treatment of fine grained solids such as non-ferrous metal ore concentrates with an oxygen-containing gas wherein the solids are mixed with the gas to form a suspension which is blown through a nozzle into a reaction chamber such as a vertical melting cyclone. In the reaction chamber, the solids are brought to reaction and melted. The invention is concerned with injecting a particle stream through the reaction zone as a focused open jet having mass flow velocity of greater than 50 $kg/m^2 \cdot sec$ and having a linear speed of more than 35 m/sec. The particle stream is ignited by the hot combustion gases thereof or by a pilot flame. In a preferred embodiment of the invention, the particle stream is directed along a horizontal secant of the chamber to the opposite wall.

5 Claims, 1 Drawing Figure

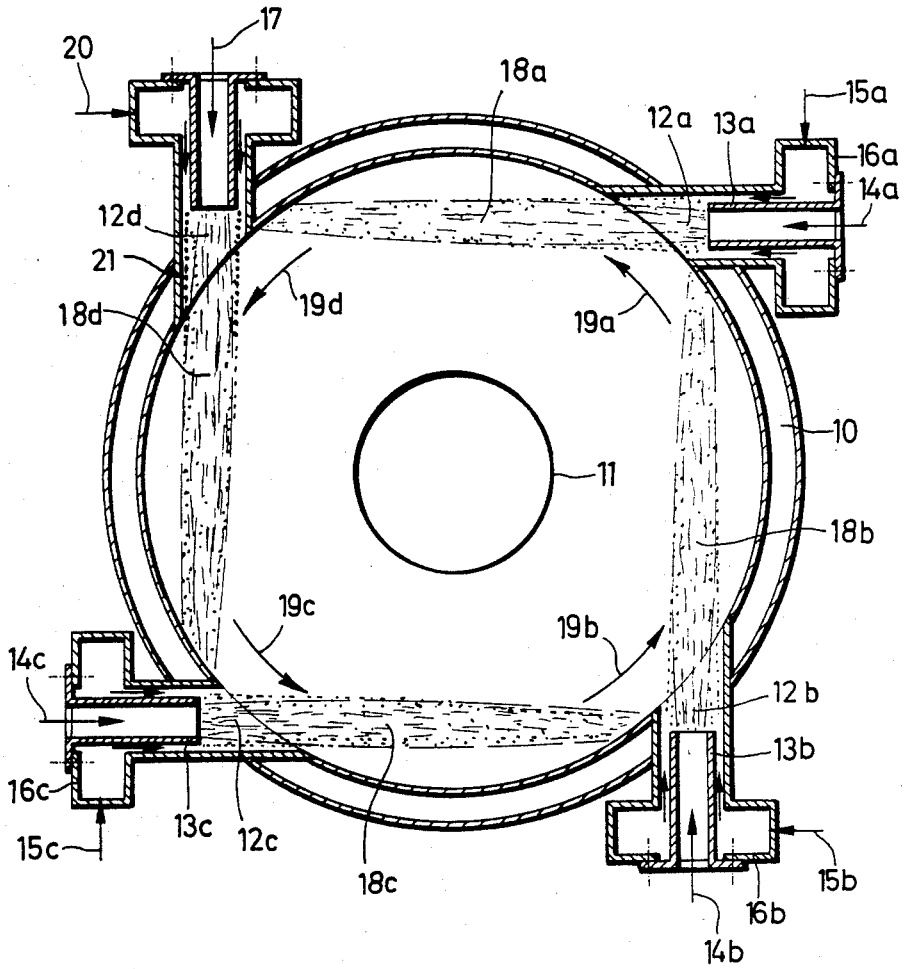
17
20
18a
15a
12a
13a
16a
14a
12d
21
19d
18d
19a
10
11
18b
19c
19b
14c
12 b
13b
16c
13c
12c
15c
18c
15b
16b
14b

METHOD AND APPARATUS FOR THE PYROMETALLURGICAL TREATMENT OF FINE GRAINED SOLIDS TO PRODUCE MOLTEN PRODUCTS

This is a division of application Ser. No. 657,122, filed Oct. 3, 1984, now U.S. Pat. No. 4,566,903.

BACKGROUND OF THE INVENTION

1. Field of the Invention

This invention is in the field of pyrometallurgical treating processes and apparatus wherein a suspension of fine grained particles such as non-ferrous metal ore concentrates in an oxygen-containing gas are injected into a reaction zone and melted. This application has subject matter in common with U.S. Ser. No. 480,021 which was allowed on July 30, 1984 and its disclosure is hereby incorporated into this application by reference.

2. Description of the Prior Art

The subject matter of the previous application, Ser. No. 480,021, assigned to the same assignee as the present application, referred to a method and apparatus for carrying out pyrometallurgical processes, particularly for reaction melting of fine grained solids which were conducted through a nozzle as an exothermally reacting solids/gas mixture and then blown onto a melt in a vertical particle beam having a high mass flow velocity. For the formation of the vertical particle stream, the fine grained solid, for example a sulfidic non-ferrous metal ore concentrate, was conveyed suspended in oxygen through an accelerating nozzle. The nozzle was disposed in the roof wall of a melting reactor. An annular pilot flame was provided which concentrically surrounds the stream in the region of the orifice of the nozzle and serves to ignite the particle stream. Since high volatilization rates of accompanying volatile metals and high melting rates of non-volatile constituents are achieved in the burning particle stream because of the high temperatures above about 1700° K., the large reaction surface and the intensive material exchange between gas and solids, the reaction melting process of the previous application has particular significance for the pyrometallurgical direct production of copper from sulfidic copper ore concentrates or even from complex concentrates with the production of a relatively pure raw copper and a low copper slag.

SUMMARY OF THE INVENTION

The present invention provides an improvement on the subject matter of the previous application Ser. No. 480,021. In the new process, the particle stream is injected through the reaction chamber as a focused open jet having a mass flow velocity greater than 50 kg/m$^2$. sec and has a high linear speed of more than 35 m/sec which prevents a flashback in the jet. The particle stream is ignited by its own hot combustion gases and/or by means of a pilot light.

The high mass flow velocity of the particle stream of the solids which become molten at processing temperatures causes a high particle stream velocity of greater than 35 m/sec and this value is increased even further when the relative concentration of oxygen in the gas is reduced. Such high mass flow velocities and linear velocities of the particle stream permit increased specific throughput performances of the suspension melting reactor with reaction times which range in fractions of seconds. With the high particle stream velocities, no flashback from the burning part of the jet into the part adjacent to the insufflation or pressurizing nozzle which has not yet burned can occur so that the particle stream is spontaneously ignited by its hot combustion gases at temperatures of about 2000° K. The combustion gases are conducted back to the exit orifice of the insufflation nozzle or are suctioned in by the particle stream or they can be ignited by a pilot light.

In a special feature of the present invention, the particle stream is injected in an essentially vertical melting cyclone which forms the reaction chamber. The particle stream is injected such that it forms a relatively horizontal secant or chord to the circumference of the cyclone which lies at a distance from the inside wall of the cyclone. By applying the particle stream in a vertical melting cyclone, the specific throughput performance can be further increased particularly when related to the volume of the reaction chamber. Since the particle stream is not injected into the melting cyclone tangentially but along a secant relative to the inside circumference of the cyclone, the cooled cyclone wall does not drain too much heat from the particle stream so that the volatilization rate of the accompanying metals and the melting rate of the non-volatile constituents can be maximized. The use of secantial injection instead of tangential injection of the particle stream provides a particle stream which is fanned in the melting cyclone due to a deflection sifter effect such that the larger particles proceed more quickly to the molten film situated at the inside wall of the cyclone than do the smaller solid particles, so that the particle stream is uniformly treated and reacts completely under process conditions.

The specific throughput performance of the melting cyclone is further increased in a plurality of particle streams, in accordance with the present invention, for example four, lying roughly in a horizontal cross-sectional plane of the cyclone are injected into the vertical melting cyclone forming the reaction chamber along a secant such that the particle streams do not strike one another. All of the particle streams are distributed over the circumference of the cyclone in a cross-sectional plane of the cyclone and are injected into the cyclone secantially so that they are treated in a completely identical fashion because the dwell time of all particle streams is identical with secants of the same length and the vertical distance of all particle streams from the melt discharge opening at the lower end of the melting cyclone being identical.

With a non-vertical melting cyclone such as a horizontally disposed melting cyclone as shown in the prior art (for example, DE-OS No. 20 06 945) a multiple injection of solids is possible only along the upper generated line of the cyclone as a result of the melt sump collecting at the lower inside wall of the cyclone so that multiple locations for injecting solids must be disposed in different cross-sectional planes of the melting cyclone where different reaction conditions and dwell times exist for the injected solids. This leads to a non-uniform treatment of the solids in the horizontally disposed melting cyclone. This disadvantage is avoided in the present invention because there is provided a plurality of solids insufflation openings at the same height which are distributed over the circumference of the cyclone so that the reaction conditions are the same over the entire cyclone surface.

The apparatus employed in the present invention contains at least one insufflation nozzle which is disposed in the jacket of the melting cyclone such that the nozzle discharge openings for the solids/gas suspension which emerge as a focused particle stream are directed at the cyclone wall lying opposite the nozzle, being directed thereat along a secant relative to the inside circumference of the melting cyclone.

BRIEF DESCRIPTION OF THE DRAWINGS

The single FIGURE of the drawings represents a horizontal cross section of a vertical melting cyclone embodying the principles of the present invention.

DESCRIPTION OF THE PREFERRED EMBODIMENTS

The drawing illustrates a vertical melting cyclone comprising an annular, cooled double wall 10 which tapers conically toward the bottom into a central cyclone discharge opening 11. In the upper portion, the inside diameter of the melting cyclone may amount to about 2.25 m. In this region, the wall 10 of the melting cyclone is provided with four pressurizing or insufflation nozzles 12*a* through 12*d* which are distributed along the circumference for insufflation of a suspension consisting, for example, of sulfidic copper ore concentrate and a gas containing oxygen. The identical insufflation nozzles 12*a* through 12*c* consist of an inner tube 13*a* through 13*c* through which preheated primary air is introduced as indicated by the arrows 14*a* through 14*c*. This primary air can be enriched with up to 40% oxygen and it flows in mixed with the ore concentrate. Secondary air is introduced as illustrated by arrows 15*a* through 15*c* and this air can likewise be enriched with oxygen. The secondary air is provided with a curved path in a spiral housing 16*a* through 16*c* and flows into an annular space concentrically surrounding the tubes 13*a* through 13*c* at about 100 m/sec and mixes with the suspension of concentrate/primary air in the region of the orifice of the insufflation nozzle.

In contrast to the insufflation nozzles 12*a* through 12*c*, the insufflation nozzle 12*d* operates without secondary air and with oxygen instead of primary air being injected as illustrated by the arrow 17. All four insufflation nozzles 12*a* through 12*d* are arranged in the cyclone jacket 10 such that the nozzle exit orifices for the solids/gas suspension emerge as a focused particle stream identified at 18*a* through 18*d*, which streams are directed to the cyclone wall lying opposite the nozzles. These streams are directed secantially relative to the inside circumference of the melting cyclone and the reacted, predominantly molten particles of the particle streams 18*a* through 18*d* impinge the molten film rotating on the inside wall of the cyclone at the said opposite cyclone walls. The rotational sense of the melt film is indicated by the arrows 19*a* through 19*d* which indicate the turbulence of the exhaust gases or the combustion gases being formed in the melt cyclone.

The particle streams 18*a* through 18*d* are injected into the melting cyclone as focused open jets having a mass flow velocity of greater than 50 $kg/m^2 \cdot sec$ which can be increased up to 5000 $kg/m^2 \cdot sec$ and more. The high linear speed excludes the possibility of a flashback. The streams are injected as roughly horizontal secants with linear velocities of more than 35 m/sec in the case of the nozzle operated with oxygen (12*d*) and with over 100 m/sec, for example 177 m/sec, in the case of the nozzles 12*a* through 12*c* which are operated with air or air enriched with oxygen, the velocities being measured at the nozzle orifice. At the very high temperatures of 2000° K. and above which exist, the particles in the particle stream react with the hot gases indicated at 19*a* through 19*d* which are rotating with great turbulence so that the reaction takes place in the matter of a fraction of a second and melts the non-volatile constituents. The particle streams 18*a* through 18*c* may be ignited by the hot gases 19*a* through 19*c* which themselves are rotating in the inside of the cyclone. There can be provided a separate combustible ignition gas as indicated by the arrow 20 which is introduced into the annular space of the nozzle 12*d* in the illustrated form of the invention. This produces a pilot flame which annularly surrounds the particle stream 18*d* at the nozzle orifice and is represented by dots in the drawing. The particle stream 18*d* is thereby spontaneously ignited by this pilot flame.

The reaction conditions in the melting cyclone are intensified by the manner in which the particle streams are disposed since both the exhaust gases 19*a* through 19*d* as well as the melt film formed at the inside wall of the cyclone are placed in strong rotation. The melt and the exhaust gases which are highly enriched with sulfur dioxide discharge from the melting cyclone by means of the central discharge opening 11 which is located at the lower end of the cyclone. As clearly shown in the drawing, the insufflation nozzles 12*a* through 12*d* are disposed such that the particle streams 18*a* through 18*d* secantially emerging from the nozzles do not strike one another. An intersection of the particle streams can also be avoided by locating the particle streams such that they are offset in height relative to one another. This can be achieved by means of a slight inclination of the particle streams out of the common, horizontal sectional plane of the cyclone.

The manner of particle stream melting in the vertical melting cyclone can also be efficiently applied to base materials which are difficult to process, for example, for the production of valuable metals from complex ore concentrate or from poorly reacting materials that have heretofore been stored in waste dumps such as retort residues which contain graphitized carbon which is difficult to ignite.

It should be evident that various modifications can be made to the described embodiments without departing from the scope of the present invention.

We claim as our invention:

1. An apparatus for the pyrometallurgical treatment of fine grained particles with an oxygen-containing gas to produce a molten product comprising:

a vertically disposed melting cyclone having a plurality of insufflation nozzles positioned generally in the same horizontal plane along the inner periphery of said cyclone, and means for injecting a suspension of said particles into said nozzles, the temperature of said cyclone during treatment being sufficient to create a molten film rotating on the inside wall of said cyclone, said nozzles directing their discharge to an opposite wall of said cyclone along a secant to the inside diameter to impinge said molten film, said nozzles being so spaced that their respective particle streams do not intersect one another.

2. An apparatus according to claim 1 wherein each nozzle includes:

an inner conduit, an outer conduit surrounding said inner conduit, means for introducing primary air into said inner conduit, and means for introducing secondary air into said outer conduit.

3. An apparatus according to claim 2 wherein said inner and outer conduits are concentric, and said secondary air is directed into the annular space between said inner and outer conduits.

4. An apparatus according to claim 1 wherein said melting cyclone includes a double-walled housing.

5. An apparatus according to claim 1 which includes means for igniting said suspension as it leaves said nozzle.

* * * * *